US008128441B2

(12) United States Patent
Mukuno

(10) Patent No.: US 8,128,441 B2
(45) Date of Patent: Mar. 6, 2012

(54) TERMINAL FITTING CONNECTING STRUCTURE

(75) Inventor: Junichi Mukuno, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/082,573

(22) Filed: Apr. 8, 2011

(65) Prior Publication Data

US 2011/0250798 A1 Oct. 13, 2011

(30) Foreign Application Priority Data

Apr. 8, 2010 (JP) ..... 2010-089569

(51) Int. Cl.
*H01R 13/187* (2006.01)

(52) U.S. Cl. ..... 439/845; 439/884

(58) Field of Classification Search ..... 439/845, 439/846, 843, 844, 847, 884, 927, 839, 833, 439/691, 593
See application file for complete search history.

(56) References Cited

U.S. PATENT DOCUMENTS 4,900,278 A 2/1990 Yamada et al.
5,269,712 A * 12/1993 Denlinger et al. ..... 439/845
5,340,338 A 8/1994 Sai et al.
5,588,884 A 12/1996 Rudoy et al.
7,150,660 B2 12/2006 Allgood et al.
7,789,720 B2 * 9/2010 Zinn ..... 439/845
8,038,488 B2 * 10/2011 Mukuno ..... 439/845
2003/0060090 A1 3/2003 Allgood et al.

FOREIGN PATENT DOCUMENTS

JP 59017570 2/1984

* cited by examiner

*Primary Examiner* — Phuong Dinh
(74) *Attorney, Agent, or Firm* — Gerald E. Hespos; Michael J. Porco

(57) ABSTRACT

A connecting structure has a male terminal (10) including a tab (13) and a female terminal (20) including a rectangular connecting tube (23) that receives the tab (13). A louver spring (30) is housed in the connecting tube (23) and has two spaced apart contact piece rows (31) each including juxtaposed resilient contact pieces (35) with contact portions (36) facing each other. The tab (13) resiliently contacts the contact portions (36) by being inserted between the contact portions (36) while resiliently displacing the contact piece rows (31) at the opposite sides. Inclined surfaces (15, 16) are formed adjacent a tip of the tab (13) of the male terminal (10) to gradually thin the tab (13) toward the tip. The inclined surfaces (15, 16) are formed so that the positions of base end edges (15A, 16A) connected to flat surfaces 14A differ in forward and backward directions.

13 Claims, 10 Drawing Sheets

TERMINAL FITTING CONNECTING STRUCTURE

BACKGROUND OF THE INVENTION

1. Field of the Invention

The invention relates to a connecting structure for male and female terminal fittings.

2. Description of the Related Art

U.S. Pat. No. 7,150,660 and FIG. 10 herein disclose a connecting structure for high-current terminal fittings. As shown in FIG. 10, this connecting structure has a male terminal 1 with a tab 2 in the form of a relatively thick tongue and a female terminal 3 with a rectangular connecting tube 4 into which the tab 2 is to be inserted. A louver spring 5 is housed in the connecting tube 4. The louver spring 5 has two contact piece rows each including a plurality of juxtaposed resilient contact pieces 6. The contact piece 6 has contact portions 6A arranged to face each other while being spaced apart. On the other hand, inclined surfaces 7 are formed on opposite surfaces of a tip of the tab 2 and taper the tip for guiding purposes.

The tab 2 of the male terminal 1 is guided into the louver spring 5 when being inserted into the connecting tube 4 of the female terminal 3 and thrusts itself between the contact portions 6A at the opposite sides while resiliently displacing the rows of the resilient contact pieces 6 at the opposite sides. Thus, the tab 2 is sandwiched resiliently between the contact portions 6A at the opposite sides for electrically connecting the tab 2 and the louver spring 5, and consequently the male and female terminal fittings 1, 2.

A variation of an insertion force of the tab 2 is shown by a characteristic curve x of FIG. 9. Specifically, the tip of the tab 2 contacts the contact portions 6A of the resilient contact pieces 6 at the opposite sides and then the tab 2 is pushed in while resiliently displacing the resilient contact pieces 6, i.e. receiving an insertion load to gradually increases. The tab 2 receives a largest load when base end edges 7A of the inclined surfaces 7 pass the contact portions 6A and then the load gradually decreases. More particularly, a load peak is reached when the tab 2 is inserted a predetermined distance after the base end edges 7A of both inclined surfaces 7 contact the contact portions 6A. This is thought to be because the base end edges 7A pass the contact portions 6A at a delayed timing due to a backward displacement of the louver spring 5 or inclination of the resilient contact pieces 6 resulting from a housing tolerance of the louver spring 5. At any rate, this conventional connecting structure is such that the base end edges 7A of both inclined surfaces 7 on the tip of the tab 2 simultaneously pass the contact portions 6A of the rows of the resilient contact pieces 6 at the opposite sides. Thus, a large insertion load is received during a connecting operation, i.e. a large insertion force (about 75N) is necessary, which has been a problem in ensuring a smooth connecting operation.

The present invention was developed in view of the above situation and an object thereof is to reduce an insertion force by a simple structural change.

SUMMARY OF THE INVENTION

The invention relates to a terminal fitting connecting structure, comprising a male terminal with a tab; and a female terminal including a connecting tube into which the tab is inserted. The connecting tube preferably is substantially rectangular. Contact portions are provided at positions substantially equidistant from the leading end of the connecting tube of the female terminal on substantially facing surfaces of the connecting tube to sandwich the tab in a thickness direction.

The contact portion at least at one side is provided on a resilient contact piece arranged on the facing surface, and the tab resiliently contacts the contact portions by being inserted between the contact portions while resiliently displacing the resilient contact piece. Inclined surfaces are formed on opposite surfaces of the tab of the male terminal to gradually thin the tab toward the tip and the respective inclined surfaces are formed such that the positions of base end edges connected to flat surfaces of the tab differ in forward and backward directions.

When being at least partly inserted into the connecting tube portion of the female terminal, the tab of the male terminal is pushed in while resiliently displacing the resilient contact piece. First, as the base end edge of the inclined surface located more forward passes the corresponding contact portion, a relatively small first peak of an insertion force is reached. Thereafter, as the base end edge of the inclined surface located more backward passes the corresponding contact portion, a similarly relatively small second peak of an insertion force is reached. In other words, in the case of inserting the tab, the insertion force is distributed to have relatively small peaks at two positions, with the result that the insertion force is reduced. Further, a reduction in the insertion force is dealt with by a simple structural change of making the positions of the respective base end edges different in forward and backward direction.

Both inclined surfaces of the tab of the male terminal may have the same angle of inclination so that middle positions of both inclined surface in a thickness direction of the tab are displaced from a center of the tab in the thickness direction. Alternatively, the inclined surfaces of the tab of the male terminal may extend at different angles of inclination in obliquely upward and downward directions from tip edges at the middle thickness position of the tip surface of the tab.

Resilient contact pieces preferably are arranged substantially symmetrically on the facing surfaces of the connecting tube of the female terminal.

A louver spring preferably is housed in the connecting tube of the female terminal and preferably has contact piece rows with juxtaposed resilient contact pieces arranged to substantially face each other while being spaced apart. The tab is inserted between the contact piece rows at opposite sides in the louver spring member while resiliently displacing the contact piece rows.

Excessive deformation preventing portions preferably are provided on rear edge portions of the facing surfaces in the connecting tube of the female terminal while being spaced apart by a distance substantially equal to the thickness of a flat portion of the tab of the male terminal.

The inclined surfaces of the tab of the male terminal preferably are formed in an area of the tab that projects back from the rear edge of the connecting tube when the tab is inserted a proper distance into the connecting tube.

The flat surfaces of the tab substantially face the excessive deformation preventing portions at the rear side when the tab is inserted by the proper amount.

A distance between the projecting ends of the upper and lower excessive deformation preventing portions preferably is slightly longer than the thickness of the flat portion of the tab.

Positioning pieces of the louver spring preferably enter positioning holes or recesses of the connecting tube and/or locking pieces of the louver spring pass respective locking portions of the connecting tube to restore and engage the inner surfaces of the locking portions when the louver spring is inserted to a proper position.

The peripheral edge of the tip surface of the tab may be rounded.

The inclined surfaces may be provided over substantially the full width of the tab.

To reduce an overall level of the insertion force of the tab, it is more effective if the inclination of the inclined surfaces is more moderate and the lengths of the inclined surface are longer. On the other hand, the length of the tip portion projecting from the rear edge of the connecting tube when the tab is inserted by a proper amount is limited, for example, to avoid interference with a core of a wire connected to a barrel by crimping. Here, if inclined surfaces are formed beyond the projecting area of the tip portion of the tab, base ends of the inclined surfaces engage with the excessive deformation preventing portions provided on the rear edge of the connecting tube. Therefore a function of preventing shaking and twisting movements of the tab cannot be fulfilled sufficiently.

In contrast, the upper and lower inclined surfaces are formed only in the projecting area of the tip of the tab while being inclined as moderately as possible. Thus, the flat surfaces of the tab face the excessive deformation preventing portions on the rear edge when the tab is inserted by the proper amount. As a result, the function of preventing shaking and twisting movements of the tab can be fulfilled reliably.

Accordingly, it is possible to reduce an insertion force by a simple structural change of the male terminal.

These and other objects, features and advantages of the invention will become more apparent upon reading the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

One particular embodiment of the present invention is described with reference to FIGS. 1 to 9.

Figure 1:
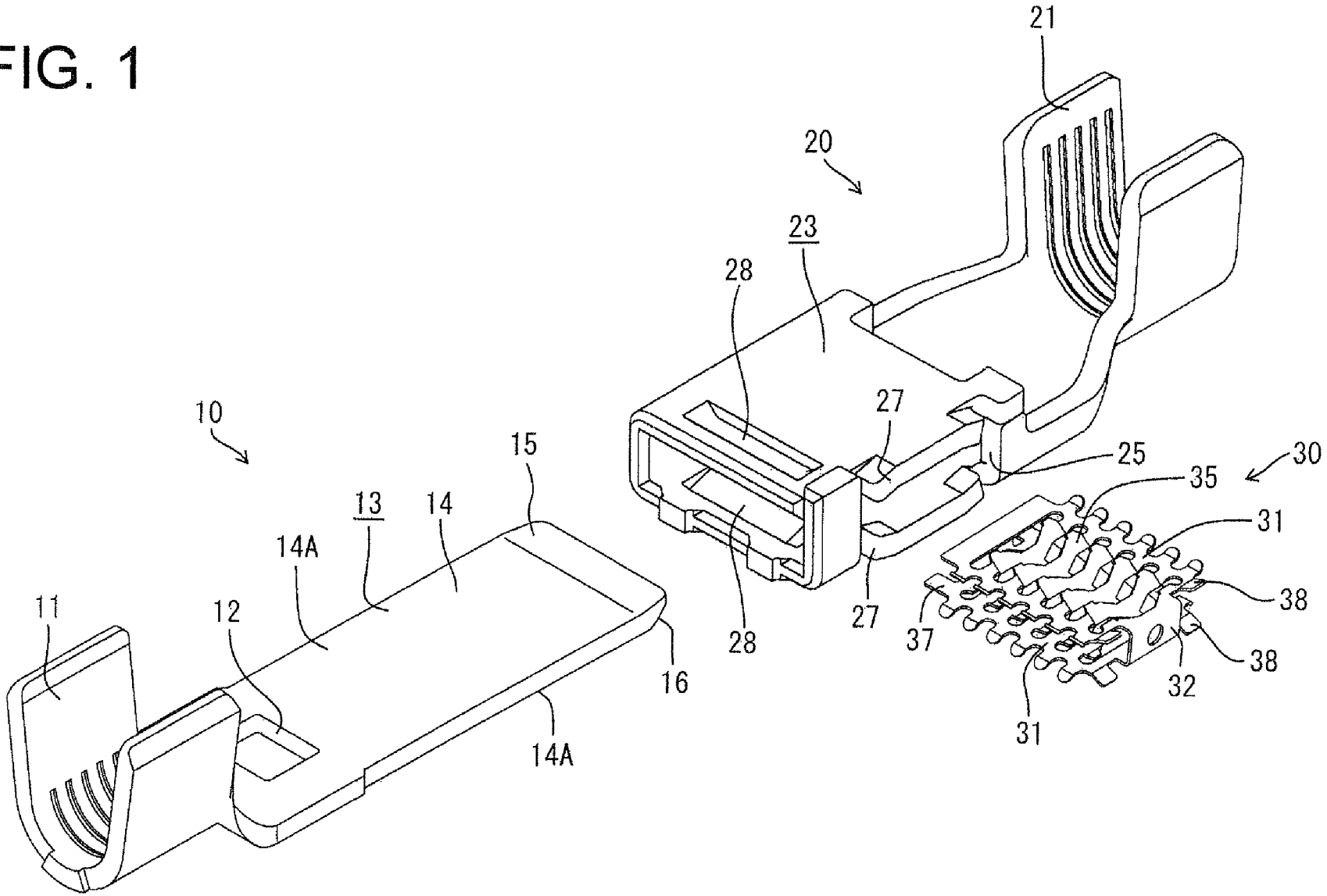
FIG. 1 is an exploded perspective view of terminal fittings according to one embodiment of the invention.
Figure 2:
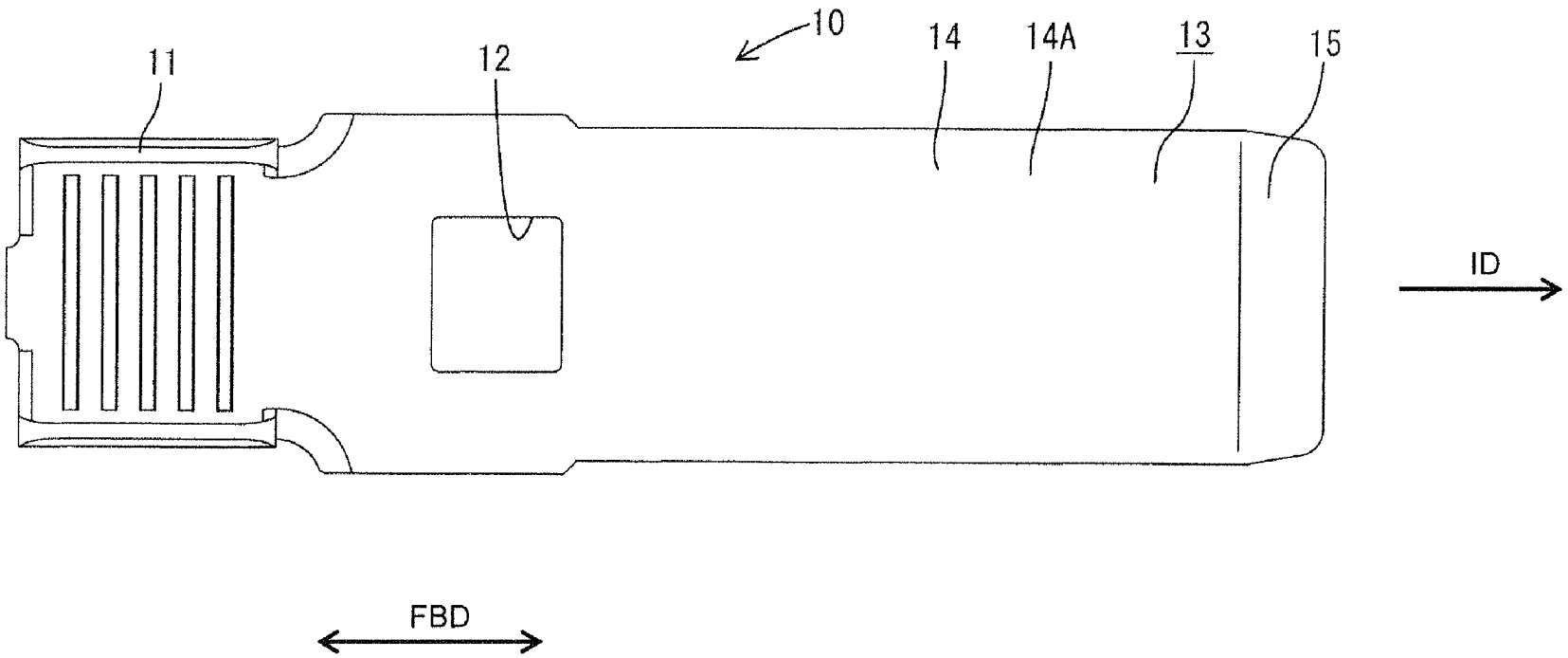
FIG. 2 is a plan view of a male terminal.
Figure 3:
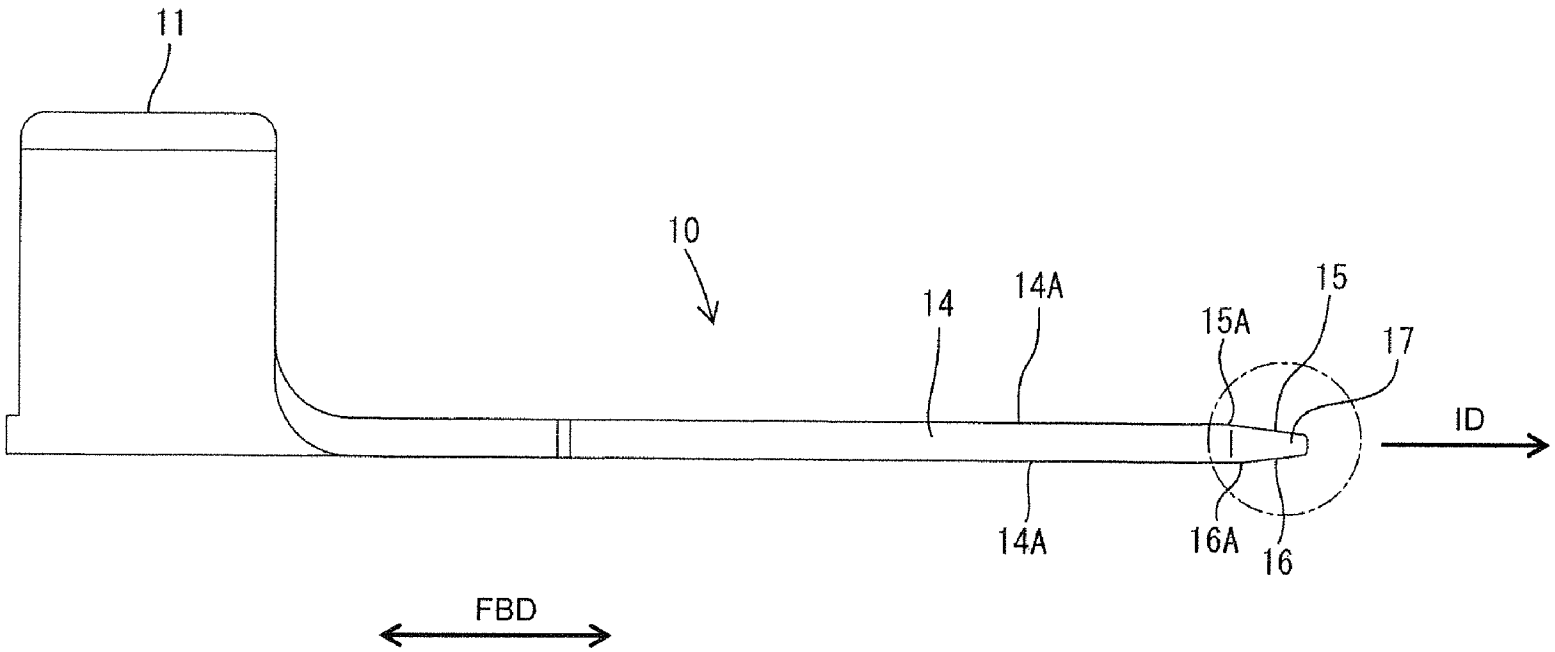
FIG. 3 is a side view of the male terminal.
Figure 4:
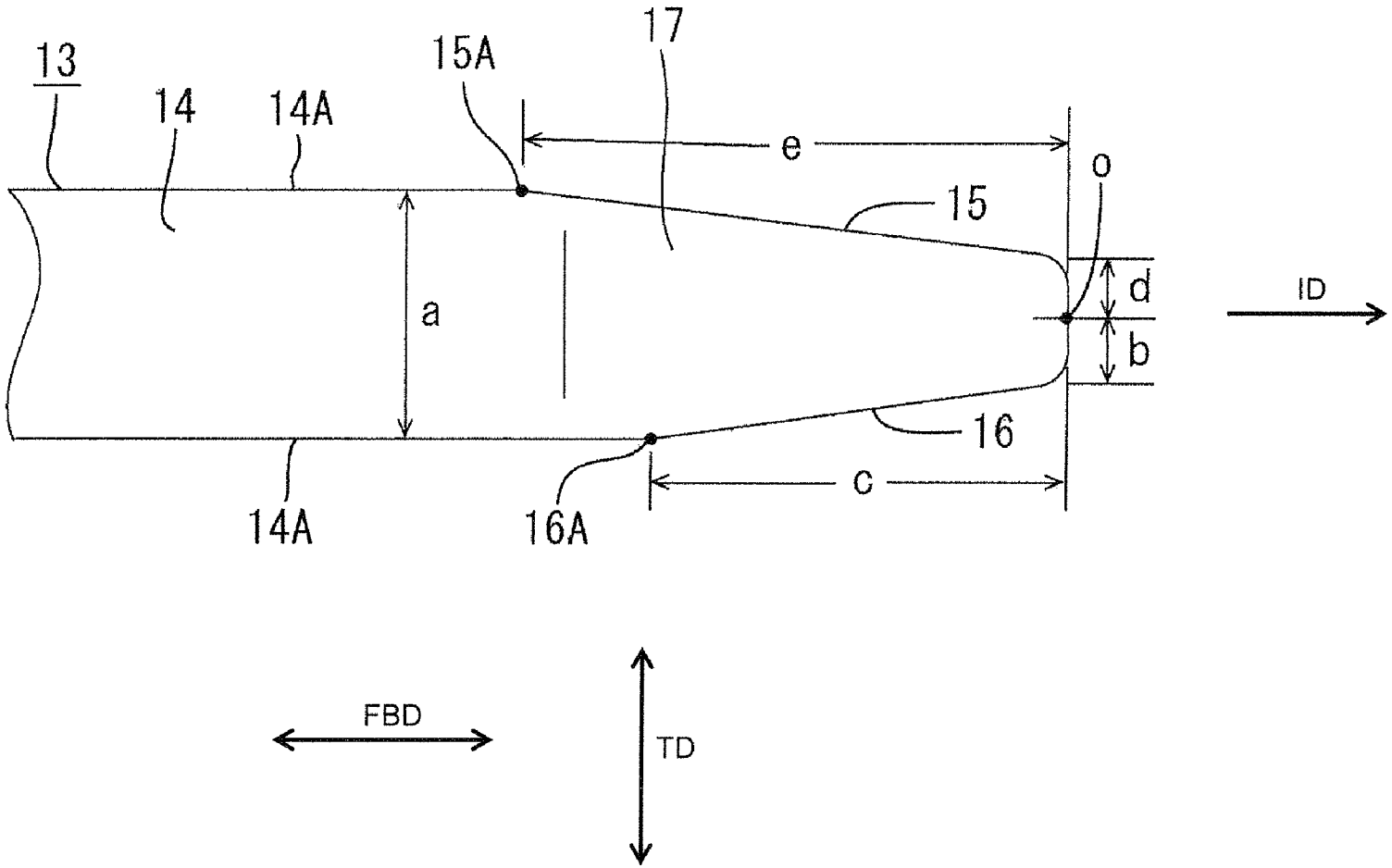
FIG. 4 is a partial enlarged view of FIG. 3.

In this embodiment is illustrated high-current terminal fittings used e.g. for a power supply line of an electric vehicle, a hybrid vehicle or the like. As shown in FIG. 1, a connecting structure includes a pair of a male terminal 10 and a female terminal 20 connectable to each other.

The male terminal 10 is formed by press-working a conductive (particularly metal) plate with good electrical conductivity such as copper alloy and having a relatively large thickness (e.g. 1.5 mm). A tab 13 in the form of a tongue piece particularly with a substantially constant width is formed before a wire connection portion to be connected to an unillustrated wire, the wire connection portion particularly comprising a barrel 11 to be crimped, bent or folded and connected to an end of a core of the unillustrated insulated wire. A base end portion of the tab 13 is slightly widened, and a locking hole or recess 12 used to retain the male terminal 10 in a male housing (not shown) is formed.

Inclined surfaces 15, 16 for guiding purpose are formed on or near a tip portion of the tab 13. Particularly, the inclined surfaces 15, 16 are provided substantially over the full width extension of the tab 13 (see e.g. FIG. 2). These are described in detail later.

Figure 5:
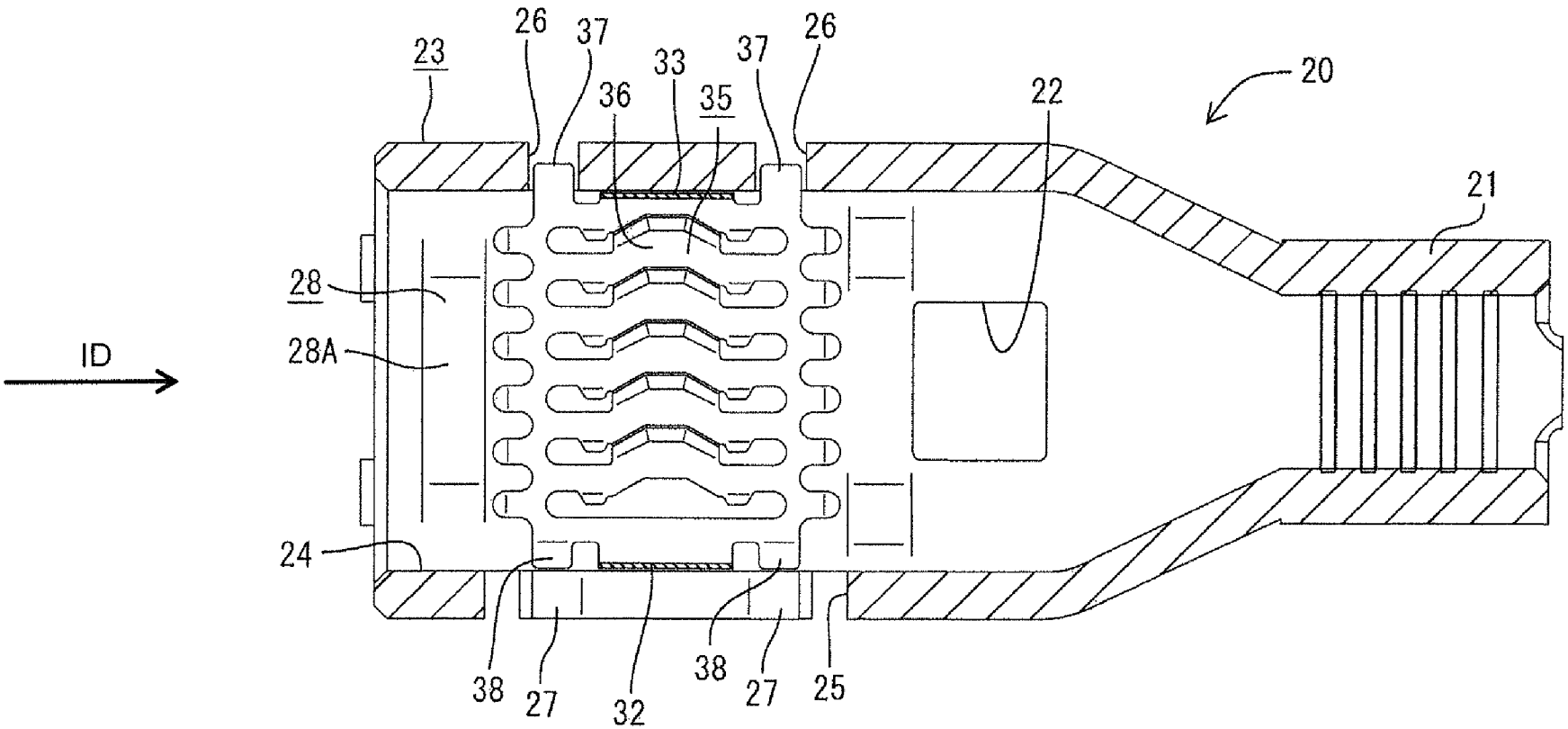
FIG. 5 is a plan view in section of a female terminal.
Figure 6:
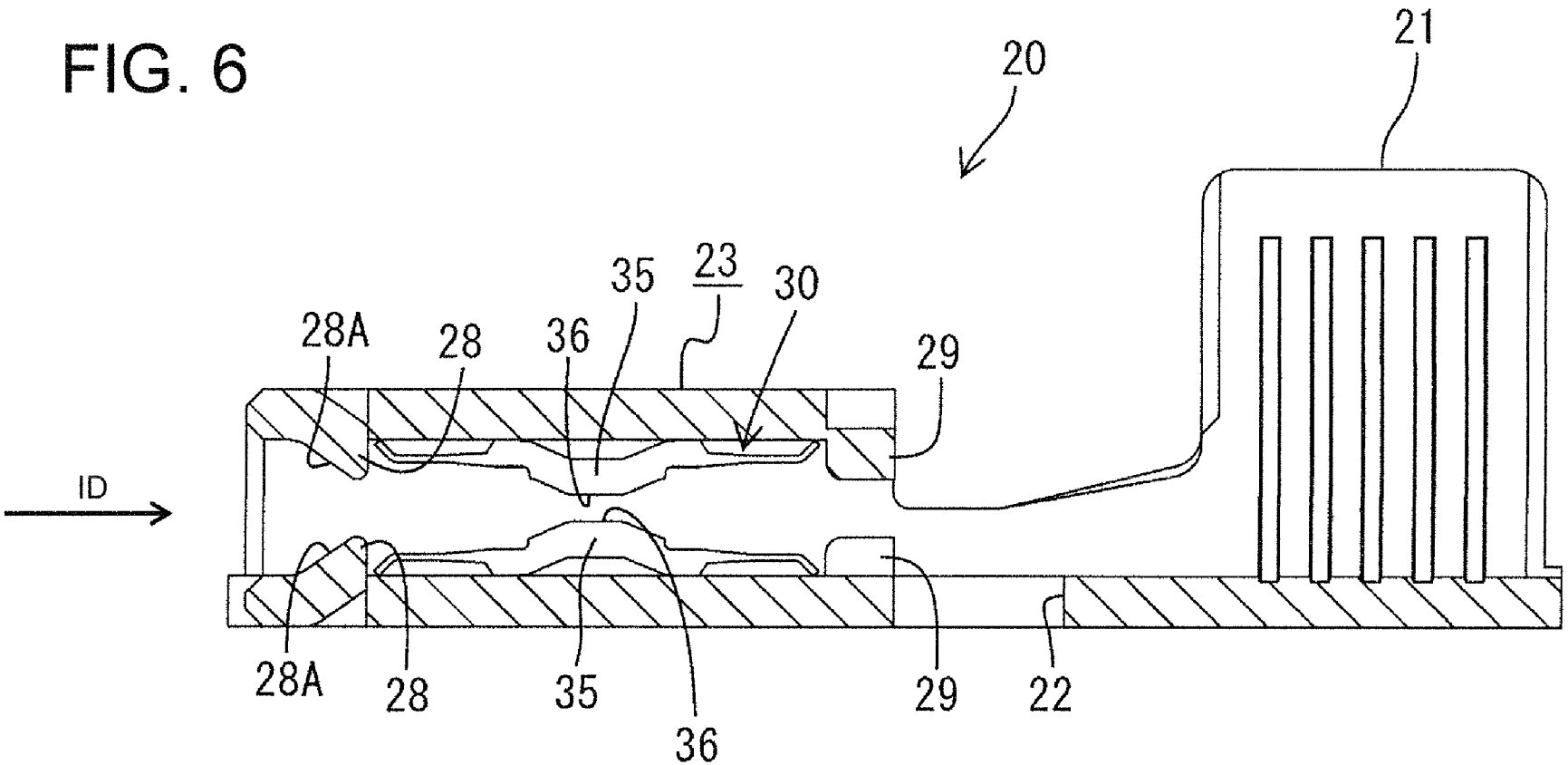
FIG. 6 is a longitudinal section of the female terminal.

On the other hand, the female terminal 20 is structured to have a built-in louver spring member 30. As also shown in FIGS. 5 and 6, the female terminal 20 is likewise formed by press-working a conductive (particularly metal) plate with good electrical conductivity such as copper alloy and having a relatively large thickness (e.g. 1.5 mm), wherein a connecting tube portion 23 into which the tab 13 of the above male terminal 10 is to be at least partly inserted is formed before a wire connection portion to be connected to an unillustrated insulated wire, the wire connection portion comprising a barrel 21 to be crimped, bent or folded and connected to an end of a core of the insulated wire and the louver spring member 30 is at least partly housed or arranged in this connecting tube portion 23. A locking hole or recess 22 used to retain the female terminal 20 housed in or arranged at a female housing (not shown) is formed in a lateral or bottom plate between the barrel 21 and the connecting tube portion 23.

The connecting tube portion 23 particularly substantially is in the form of a flat rectangular tube having open front and/or rear ends, and an opening in the front surface serves as an entrance 24 through which the tab 13 is to be at least partly inserted. A louver insertion opening 25 through which the louver spring member 30 is to be at least partly inserted is formed in a lateral (e.g. right) wall of the connecting tube portion 23 when viewed from front.

The louver spring member 30 is formed by press-working a plate member made of a conductive material more resilient than the female terminal 20 such as copper beryllium. Roughly, the louver spring member 30 is such that front ends of two upper and lower contact plates 31, which are arranged to substantially face each other while being spaced apart by a specified (predetermined or predeterminable) distance, in an inserting direction are connected by a coupling plate 32 and a receiving plate 33 for at least partly receiving the back end edge of the upper contact plate 31 is formed to stand up or project at an angle different from 0° or 180°, preferably substantially at a right angle from (particularly the back end edge of) the lower contact plate 31, and/or particularly substantially has a flat rectangular or polygonal tube shape as a whole.

In each of the shown contact plates 31, a plurality of (e.g. five) resilient contact pieces 35 (particularly supported at or near both ends) and substantially extending in a width direction, i.e. substantially an inserting direction ID of the tab 13 are formed at intervals. Accordingly, the both contact plates 31 particularly correspond to contact piece rows. Each resilient contact piece 35 particularly includes an inwardly projecting longitudinal central part, and a substantially flat part in a specified (predetermined or predeterminable) range of a projecting end serves as a contact portion 36.

When viewed from front, the respective upper resilient contact pieces 35 are inclined toward right and, conversely, the respective lower resilient contact pieces 35 are inclined at the substantially same angle toward left. Vertical distances between the contact portions 36 of the upper and lower resilient contact pieces 35 are set to be shorter than the thickness of a flat portion 14 (whose upper and lower surfaces are parallel flat surfaces 14A) of the tab 13 by a specified (predetermined or predeterminable) dimension.

One or more positioning pieces 37 are formed to project from opposite end portions of the back edge of the lower contact plate 31, and one or more locking pieces 38 are formed to substantially extend obliquely outward respectively from (particularly substantially opposite end portions of) the front end edge(s) of the upper and/or lower contact plates 31.

As shown in FIG. 5, one or more positioning holes or recesses 26 into which the respective positioning pieces 37 are to be at least partly inserted are formed at bottom end positions of the lateral (left) wall of the connecting tube portion 23, and (particularly substantially opposite end portions of) the upper and/or lower opening edges of the louver insertion opening 25 particularly are hammered to project inwardly, thereby forming one or more locking portions 27 engageable with the one or more respective locking pieces 38.

When the louver spring member 30 is at least partly inserted into the connecting tube portion 23 through the louver insertion hole 25, the one or more positioning pieces 37 are located right before the one or more respective positioning holes 26 and the upper and/or lower locking pieces 38 are resiliently displaced at a final stage of insertion. When the louver spring member 30 is inserted to a proper position where the receiving plate 33 at the back side comes into contact with the lateral (e.g. left) wall, the positioning pieces 37 at least partly enter the positioning holes 26 and/or the locking pieces 38 pass the locking portions 27 to be engaged with the inner surfaces of the locking portions 27 while being at least partly restored. In this way, the louver spring member 30 is housed while being closely fitted into the connecting tube portion 23 of the female terminal 20, positioned in a longitudinal direction of the connecting tube portion 23, and retained in the inserting direction of the louver spring member 30.

In a state where the louver spring member 30 is inserted at the proper position in this way, the contact portions 36 of the upper and lower resilient contact pieces 35 are located at positions substantially equidistant from the front edge of the connecting tube portion 23 and, as described above, the vertical distances between the upper and lower contact portions 36 are maintained to be shorter than the thickness of the flat portion 14 of the tab 13 by the specified (predetermined or predeterminable) dimension.

One or more, particularly a pair of (upper and/or lower) excessive deformation preventing portions 28 are formed at a position right before a housing space for the louver spring member 30 in the connecting tube portion 23 particularly by hammering upper and lower wall portions. Specifically, the upper and/or lower excessive deformation preventing portions 28 are respectively formed to be oblique over the substantially entire width particularly by hammering. A distance between the projecting edges of the upper and/or lower excessive deformation preventing portions 28 is slightly longer than the thickness of the flat portion 14 of the tab 13 to prevent the tab 13 from being obliquely inclined or twisted about an axis line, and surfaces of the both excessive deformation preventing portions 28 at the front side serve as guide surfaces 28A, the spacing of which is widened toward the front.

One or more, particularly a pair of (upper and/or lower) excessive deformation preventing portions 29 are likewise formed at a position right behind the housing space for the louver spring member 30 in the connecting tube portion 23 particularly by hammering the upper and/or lower wall portions. Specifically, the upper excessive deformation preventing portion 29 is formed at a widthwise intermediate position, particularly by hammering a widthwise central part of the upper wall, to project downward or inward and the lower excessive deformation preventing portions 29 are formed at one or more positions, particularly by hammering the lower wall at two positions, i.e. at the opposite widthwise ends, to project upward or inward. Particularly, a total of three upper and lower excessive deformation preventing portions 29 cover substantially the entire width. A distance between the projecting ends of the upper and lower excessive deformation preventing portions 29 is likewise set to be slightly longer than the thickness of the flat portion 14 of the tab 13 to prevent shaking and twisting movements of the tab 13.

In this embodiment, the shape of the tip portion of the tab 13 of the male terminal 10 is elaborated. In a specified (predetermined or predeterminable) area of the tip portion of the tab 13, the width is gradually narrowed toward the tip (i.e. in inserting direction ID) and the upper and lower surfaces are formed into inclined surfaces 15, 16 which gradually thin the tip portion toward the tip or distal end. Particularly, the upper and lower inclined surfaces 15, 16 (as particular first and second inclined surfaces) are formed such that the positions of base end edges 15A, 16A connected to the substantially flat surfaces 14A differ or are offset or displaced in forward and backward directions FBD (or along the inserting direction ID).

The both inclined surfaces 15A, 16A particularly are formed by being pressed and squashed between upper and lower molds of a press machine. Their shapes are specifically described with actual dimensions with reference to FIG. 4.

When thickness "a" of the tab 13 is more than about 1.2 mm (e.g. about 1.5 mm), the lower inclined surface 16 is formed to be inclined obliquely downwardly at an angle of less than about 10° (e.g. of "about 8°") from a tip edge at a position spaced downwardly by a distance "b" (of less than about 0.5 mm, e.g. of about 0.4 mm) from a middle thickness position "o" on the tip surface (or distal end surface) of the tab 13, and a horizontal distance "c" in forward and backward directions FBD from the tip edge to the base end edge 16A connected to the flat surface 14A is less than about 3 mm, e.g. about 2.5 mm at this time.

On the other hand, the upper inclined surface 15 is formed to be inclined obliquely upwardly likewise at an angle of less than about 10° (e.g. of "about 8°") from a tip edge at a position spaced upwardly by a distance "d" (less than the distance "b" or of less than about 0.5 mm, e.g. of about 0.35 mm) from the middle thickness position "o" on the tip surface (or distal end surface) of the tab 13, and a horizontal distance "e" in forward and backward directions FBD from the tip edge to the base end edge 15A connected to the flat surface 14A is more than the distance "c" or more than about 3 mm, e.g. 3.3 mm at this time. As a result, the base end edge 15A of the upper inclined surface 15 particularly is at a position 0.8 mm behind the base end edge 16A of the lower inclined surface 16.

Further, the peripheral edge of the tip surface of the tab 13 particularly is rounded.

A design technique for making the positions of the base end edges 15A, 16A of the upper and lower inclined surfaces 15, 16 described above different in forward and backward directions FBD is substantially the same as a design technique for forming the inclined surfaces 15, 16 to be inclined obliquely upwardly and downwardly at the same angle of inclination from tip edges at positions spaced upwardly and downwardly by the same distance from a reference point displaced downwardly from the middle thickness position "o" on the tip surface of the tab 13 by a specified (predetermined or predeterminable) dimension as described below.

Particularly, in the case of forming the upper and lower inclined surfaces 15, 16 when the tip of the tab 13 has a pointed shape with no thickness, the upper and lower inclined surfaces 15, 16 are formed at the same angle of inclination to extend in obliquely upward and downward directions like from the tip edges at the above reference point.

As described in detail later, upon connecting the both terminal fittings 10, 20, the tab 13 of the male terminal 10 is at least partly inserted into the connecting tube portion 23 of the female terminal 20 and passes through or contacts the louver spring member 30 at least partly housed in the louver spring member 30. When the tab 13 is at least partly inserted by a proper amount, an area 17 of the tip portion of the tab 13 where the inclined surfaces 15, 16 are formed at least partly projects backward from the rear edge of the connecting tube portion 23, i.e. the flat surfaces 14A of the tab 13 face the excessive deformation preventing portions 29 on the rear edge of the connecting tube portion 23 as shown in FIG. 8(*e*).

In other words, the upper and lower inclined surfaces 15, 16 are formed in the area 17 of the tip portion at least partly projecting from the rear edge of the connecting tube portion 23 of the female terminal 20 when the tab 13 of the male terminal 10 is inserted by the proper amount. This significance is as follows.

To reduce an overall level of the insertion force of the tab 13, it is more effective if the inclination of the inclined surfaces 15, 16 is more moderate and the lengths of the inclined surface 15, 16 are longer. On the other hand, the length of the tip portion particularly projecting from the rear edge of the connecting tube portion 23 when the tab 13 is inserted by the proper amount is limited to avoid interference with the core of the wire connected to the wire connection portion, particularly to the barrel 11 by crimping. Here, if inclined surfaces are formed beyond the projecting area of the tip portion of the tab 13, base end sides of the inclined surfaces are engaged with the excessive deformation preventing portions 29 provided on the rear edge of the connecting tube portion 23, wherefore a function of preventing shaking and twisting movements of the tab 13 cannot be sufficiently fulfilled.

Accordingly, in this embodiment, the upper and lower inclined surfaces 15, 16 particularly are formed only in the projecting area of the tip portion of the tab 13 while particularly being inclined as moderately as possible. Thus, the flat surfaces 14 of the tab 13 substantially face the excessive deformation preventing portions 29 at the rear side when the tab 13 is inserted by the proper amount, with the result that the function of preventing shaking and twisting movements of the tab 13 can be reliably fulfilled.

Next, functions of this embodiment are described.

The male terminal 10 and the female terminal 20 are respectively at least partly housed in the male and female housings after being connected to the ends of the wires (particularly by crimping), and the both terminal fittings 10, 20 are connected as the two housings are connected. In other words, when being at least partly inserted into the connecting tube portion 23 of the female terminal 20, the tab 13 of the male terminal 10 is guided into the louver spring member 30 at least partly housed in the connecting tube portion 23 and thrusts itself between the contact portions 36 at the opposite sides while resiliently displacing the upper and lower rows of the resilient contact pieces 35. The tab 13 inserted by the proper amount is resiliently sandwiched between the contact portions 36 at the opposite sides, whereby the tab 13 and the louver spring member 30, consequently the male and female terminal fittings 10, 20 are electrically connected.

Figure 7:
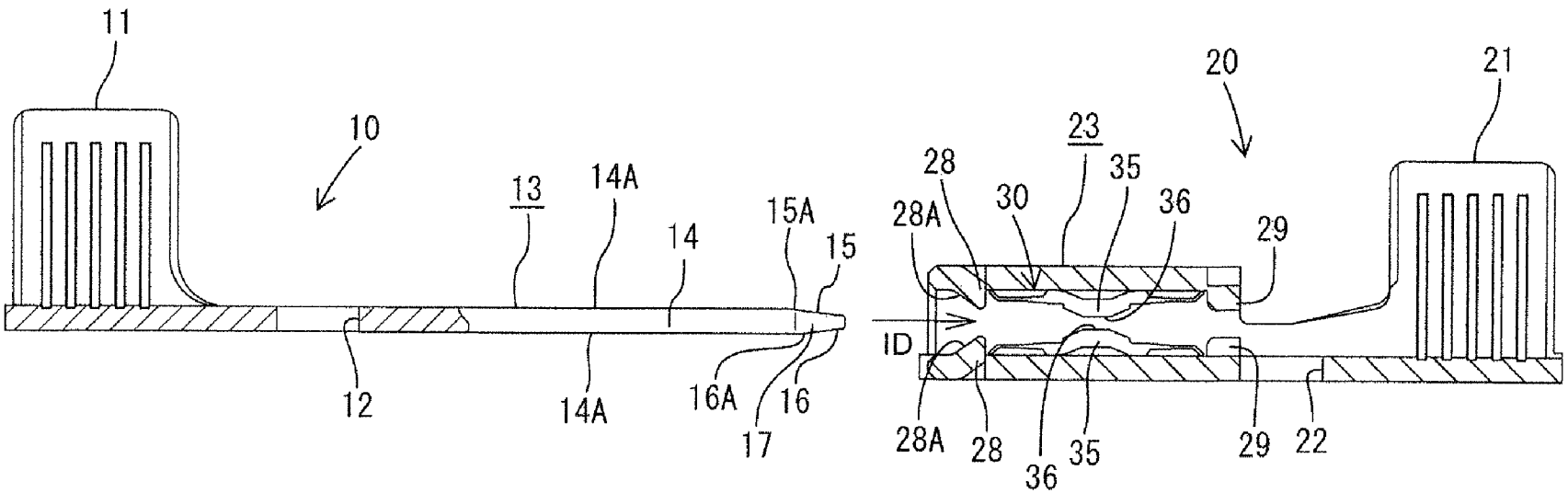
FIG. 7 is a section of the male and female terminal fittings before connection.
Figure 8A:
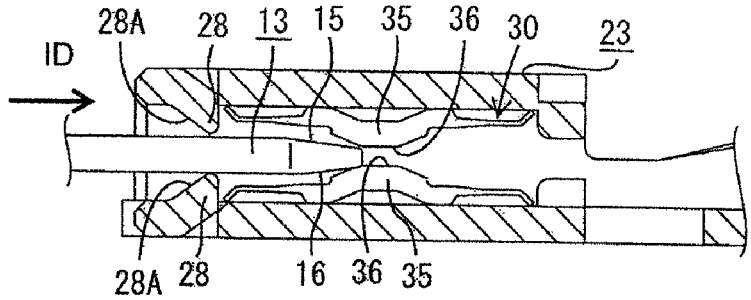
FIG. 8 are sections showing a connection process.
Figure 8B:
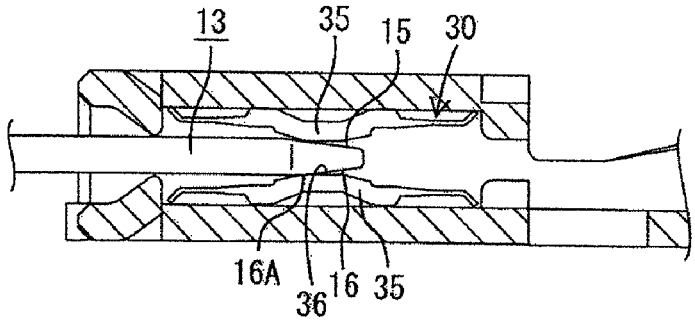
Figure 8C:
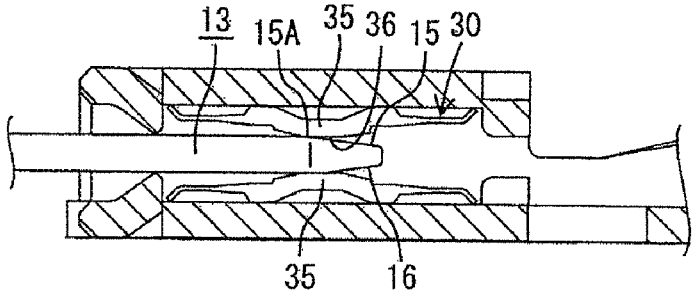
Figure 8D:
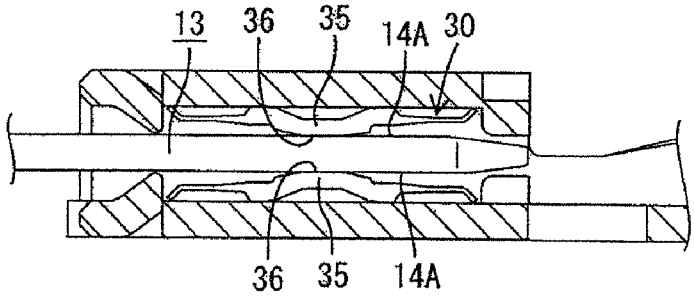
Figure 8E:
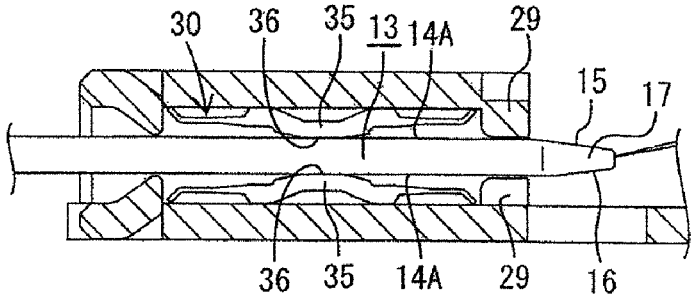
Figure 9:
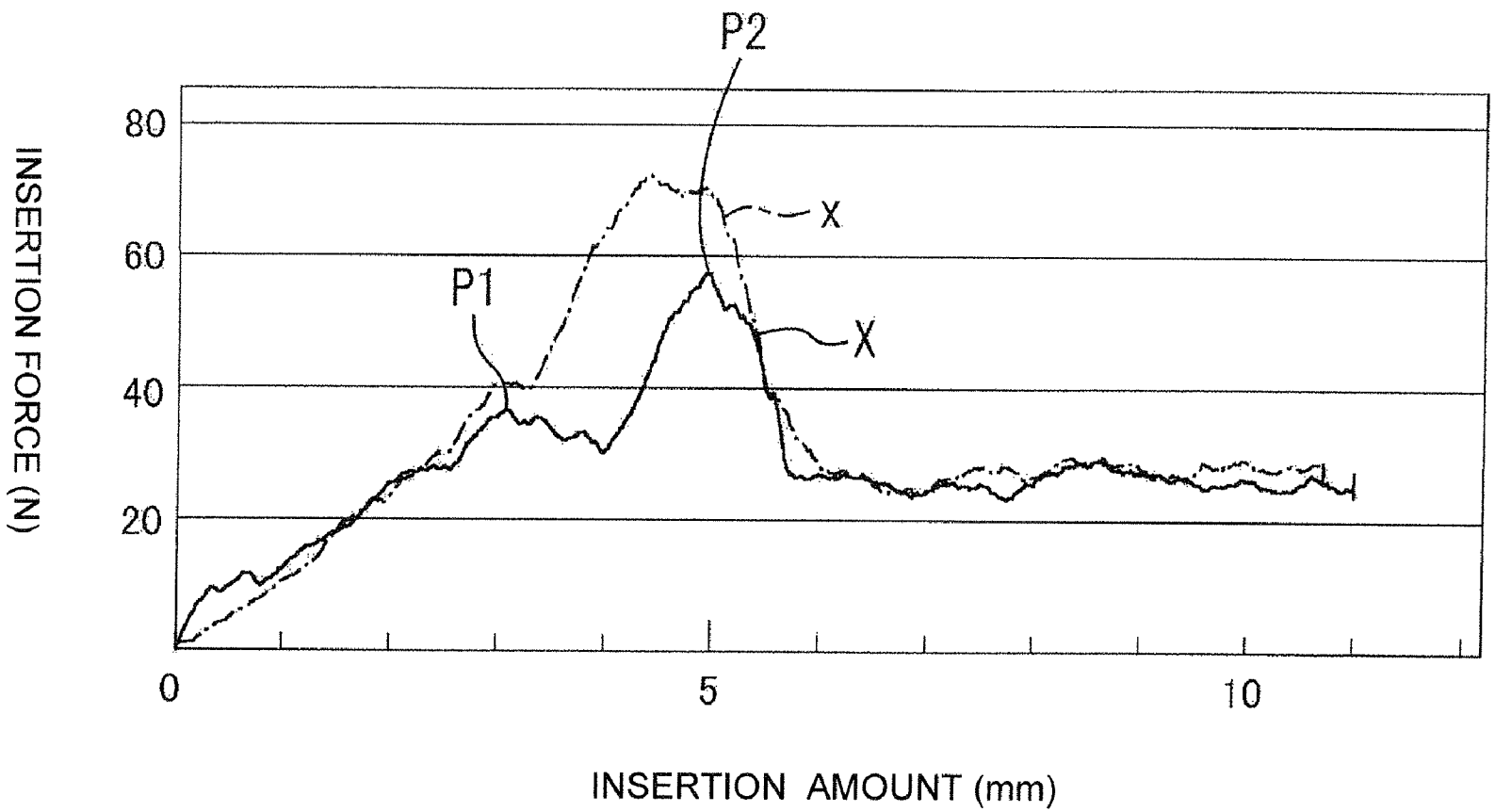
FIG. 9 is a graph showing characteristics of insertion force in relation to insertion amount.
Figure 10:
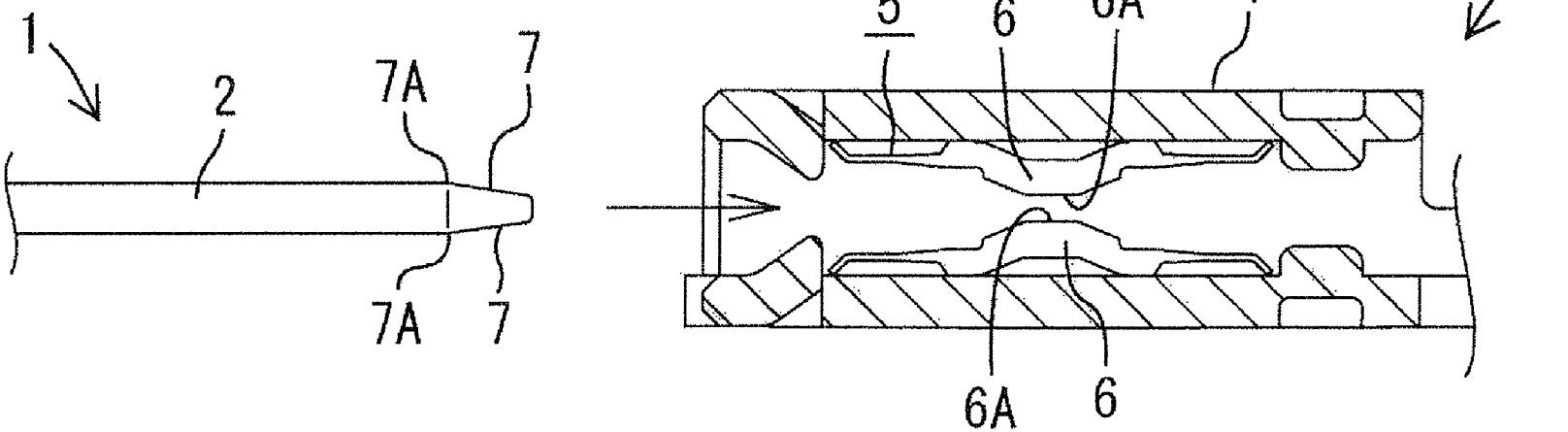
FIG. 10 PRIOR ART
FIG. 10 is a section of a prior art.

Here, a variation of the insertion force of the tab 13 of the male terminal 10 according to this embodiment is as follows. An experiment was conducted by inserting the tab 13 of the male terminal 10 into the connecting tube portion 23 of the female terminal 20 at a constant speed as shown in FIG. 7, measuring a load (insertion force) by a load cell in the process of further inserting the tab 13 after the tip of the tab 13 came into contact with the upper and lower contact portions 36 of the louver spring member 30, and graphing (characteristic curve X) a relationship between an insertion amount (mm) of the tab 13 and an insertion force (N) as shown in FIG. 9.

A specific insertion process of the tab 13 of the male terminal 10 is described again with reference to FIG. 8. When being at least partly inserted into the connecting tube portion 23, the tip of the tab 13 is inserted between the upper and lower rows of the resilient contact pieces 35 of the louver spring member 30 particularly while substantially being centered, so to speak, by being guided by the guide surfaces 28A of the front excessive deformation preventing portions 28. First, as shown in FIG. 8(*a*), the tip surface of the tab 13 comes into contact with the front edges of the contact portions 36 of the upper and lower resilient contact pieces 35. As insertion is further continued from such a state, the both inclined surfaces 15, 16 pass the contact portions 36, whereby the tab 13 is pushed in while resiliently displacing the upper and lower resilient contact pieces 35 outwardly to gradually increase the insertion force.

Thereafter, as the base end edge 16A of the lower inclined surface 16 passes the lower contact portions 16 earlier as shown in FIG. 8(*b*), a relatively small first peak P1 (e.g. about 35 N) of the insertion force is reached. Subsequently, as the base end edge 15A of the upper inclined surface 15 passes the upper contact portions 36 as shown in FIG. 8(*c*), a relatively small second peak P2 (e.g. about 50 N) of the insertion force, though larger than the above first peak P1, is reached. Thereafter, as shown in FIG. 8(*d*), the upper and lower flat surfaces 14A pass between the upper and lower contact portions 36 together, whereby the tab 13 is inserted with a lowered constant insertion force (e.g. about 25 N). The insertion is stopped when the tip area 17 of the tab 13 including the both inclined surfaces 15, 16 particularly pass beyond the excessive deformation preventing portions 29 at the rear side as shown in FIG. 8(*e*).

Strictly speaking, the first and second peaks P1, P2 are reached when the tab 13 is further inserted a predetermined distance after the contact of the base end edges 16A, 15A of both inclined surfaces 16, 15 with the contact portions 36. This is thought to be because the base end edges 16A, 15A pass the contact portions 36 at delayed timings due to a backward displacement of the louver spring member 30 or inclination of the resilient contact pieces 35 resulting from a housing tolerance of the louver spring member 30.

As described above, according to this embodiment, the base end edges 15A, 16A of the respective inclined surfaces 15, 16 connected to the substantially flat surfaces 14A are formed at different positions in forward and backward directions FBD upon forming the inclined surfaces 15, 16 on the upper and lower surfaces of the tip portion of the tab 13 of the male terminal 10. Thus, upon inserting the tab 13 into the louver spring member 30 built in the female terminal 20, the insertion force is distributed to have relatively small peaks (35N, 50N) at two positions. As compared with the case in the prior art where a large peak (70 N) is reached at one position, the insertion force is reduced. Therefore, the male and female terminal fittings 10, 20 can be efficiently connected.

Further, a reduction of the insertion force is dealt with by a simple structural change of making the positions of the base end edges 15A, 16A of the respective upper and lower inclined surfaces 15, 16 formed on the tip portion of the tab 13 different in forward and backward directions FBD and, hence, inexpensively dealt with.

Furthermore, since the both upper and lower inclined surfaces 15, 16 particularly are formed only in the tip area 17 which particularly projects from the rear edge of the connecting tube portion 23 when the tab 13 is inserted by the proper amount, the flat surfaces 14A of the tab 13 can substantially face the excessive deformation preventing portions 29 at the rear side when the tab 13 is inserted by the proper amount. Therefore, the function of preventing shaking and twisting movements of the tab 13 by the excessive deformation preventing portions 29 can be reliably fulfilled.

The invention is not limited to the above described and illustrated embodiment. For example, the following embodiments are also included in the technical scope of the present invention.

As the design technique for making the positions of the base end edges of the upper and lower inclined surfaces provided on the tip portion of the tab of the male terminal different in forward and backward directions, it may also possible to form the respective inclined surfaces to extend at different angles of inclination in obliquely upward and downward directions from tip edges at the middle thickness position of the tip surface of the tab or at positions spaced upwardly and downwardly from the middle thickness position by the same distance in addition to the above design technique illustrated in the above embodiment.

The positions of the respective base end edges of the upper and lower inclined surfaces of the tip portion of the tab may be set such that the lower base end edge is located behind the upper base end edge contrary to the above embodiment.

Numerical values indicating the positions of the tip edges of the respective inclined surfaces, the angle of inclination and the like illustrated in the above embodiment upon set the positions of the respective base end edges of the inclined surfaces of the tab are merely examples and suitable numerical values can be selected according to conditions such as the thickness of the tab.

Instead of housing the separate louver spring member in the connecting tube portion in the female terminal, each of the upper and lower wall portions of the connecting tube portion may be directly hammered to form a plurality of resilient contact pieces.

The numbers of the resilient contact pieces arranged on the respective upper and lower surfaces of the connecting tube portion are arbitrary, including one, and may differ between the upper and lower sides.

So long as the contact portions are located at substantially symmetrical positions at the upper and lower sides, the contact portions at either the upper or lower side may be fixed. Such a mode is also included in the technical range of the present invention.

What is claimed is:

1. A terminal fitting connecting structure, comprising:

a female terminal (20) including a connecting tube (23), contact portions (36) being provided at positions substantially equidistant from a leading end of the connecting tube (23) on substantially facing surfaces of the connecting tube (23), the contact portion (36) on at least at one side being provided on a resilient contact piece (35) on the facing surface; and a male terminal (10) including a tab (13) with opposite front and rear ends spaced apart along forward and rearward directions (FBD) and configured for insertion into the connecting tube (23), the tab (13) resiliently contacting the contact portions (36) by being inserted between and contacting the contact portions (36) while resiliently displacing the resilient contact piece (35) so that the contact portions (36) sandwich the tab (13) in a thickness direction (TD), the tab (13) having a tip at the front end of the tab (13), flat surfaces (14A) on opposite sides of the tab (13) and spaced from the tip and inclined surfaces (15, 16) extending from the respective flat surfaces (14A) to the tip and gradually converging toward the tip, base end edges (15A, 16A) being defined on ends of the inclined surfaces (15, 16) adjacent the flat surfaces (14A), the respective inclined surfaces (15, 16) being formed so that positions where the respective base end edges (15A, 16A) connect to flat surfaces (14A) differ in the forward and backward directions (FBD).

2. The terminal fitting connecting structure of claim 1, wherein the inclined surfaces (15, 16) of the tab (13) of the male terminal (10) have substantially equal angles of inclination and middle positions of the inclined surfaces (15, 16) in the thickness direction (TD) of the tab (13) being displaced from a center (o) of the tab (13) in the thickness direction (TD).

3. The terminal fitting connecting structure of claim 1, wherein the inclined surfaces (15, 16) of the tab (13) of the male terminal extend at different angles of inclination in obliquely upward and downward directions from a center (o) of the tab (13) in the thickness direction (TD).

4. The terminal fitting connecting structure of claim 1, wherein resilient contact pieces (35) are substantially symmetrically arranged on both facing surfaces of the connecting tube (23) of the female terminal (20).

5. The terminal fitting connecting structure of claim 1, wherein a louver spring (30) is housed in the connecting tube (23) of the female terminal (20) and has two spaced apart contact piece rows (31) each including a plurality of juxtaposed resilient contact pieces (35) arranged to substantially face each other.

6. The terminal fitting connecting structure of claim 5, wherein the tab (13) is at least partly inserted between the contact piece rows (31) at opposite sides in the louver spring (30) while resiliently displacing the contact piece rows (31).

7. A terminal fitting connecting structure of claim 5, wherein opposed excessive deformation preventing portions (29) are provided on rear edges of the facing surfaces in the connecting tube (23) of the female terminal (20) while being spaced apart by a distance substantially equal to the thickness of the flat portion (14) of the tab (13) of the male terminal (10).

8. The terminal fitting connecting structure of claim 7, wherein both inclined surfaces (15, 16) of the tab (13) of the male terminal (10) are formed in an area of the tab (13) that projects back from the rear edge of the connecting tube (23) when the tab (10) is inserted a proper distance into the connecting tube (23).

9. The terminal fitting connecting structure of claim 7, wherein the flat surfaces (14A) of the tab (13) substantially face the excessive deformation preventing portions (29) at the rear edges when the tab (13) is inserted by the proper amount.

10. The terminal fitting connecting structure of claim 7, wherein a distance between the opposed deformation preventing portions (29) exceeds a thickness of the flat portion (14) of the tab (13).

11. The terminal fitting connecting structure of claim 7, wherein pieces (37) of the louver spring (30) enter respective positioning holes or recesses (26) of the connecting tube (23) when the louver spring (30) is inserted to a proper position and locking pieces (38) of the louver spring (30) pass respective locking portions (27) of the connecting tube (23) to engage inner surfaces of the locking portions (27) while being at least partly restored.

12. The terminal fitting connecting structure of claim 1, wherein the peripheral edges of the tip of the tab (13) are rounded.

13. The terminal fitting connecting structure of claim 1, wherein the inclined surfaces (15, 16) are provided over substantially an entire width of the tab (13).

* * * * *